US006129544A

United States Patent [19]

Chen

[11] Patent Number: 6,129,544

[45] Date of Patent: Oct. 10, 2000

[54] SAFETY DEVICE FOR PIEZOELECTRIC LIGHTER

[76] Inventor: Peter Chen, 16134 E. Ridge View, La Mirada, Calif. 90638

[21] Appl. No.: 09/339,052

[22] Filed: Jun. 23, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 5,228,849 | 7/1993 | Frigiere | 431/153 |
| 5,240,408 | 8/1993 | Uematsu et al. | 431/153 |
| 5,458,482 | 10/1995 | Saito et al. | 431/153 |

*Primary Examiner*—Carroll Dority

*Attorney, Agent, or Firm*—Raymond Y. Chan; David and Raymond

[57] ABSTRACT

A safety device for a piezoelectric lighter, which can prevent under age children from the usage of cigarette lighter without adult supervision, includes a locking stopper fitted in a locker groove of a cap body of a pusher cap in an inwardly movable manner and a resilient unit mounted between the locking stopper and the pusher cap to normally urge and retain the locking stopper positioning between the pusher head and the locking flange of a piezoelectric unit casing of the piezoelectric lighter, so as to block any downwardly movement of the pusher cap and thus prevent the ignition operation of the piezoelectric unit. In other words, the piezoelectric lighter is locked from ignition normally. In order to ignite the piezoelectric lighter of the present invention, an adult user's thumb must intentionally push in the locking stopper until it is unblocked by the locking flange and push down the pusher cap at the same time.

16 Claims, 8 Drawing Sheets

SAFETY DEVICE FOR PIEZOELECTRIC LIGHTER

BACKGROUND OF THE PRESENT INVENTION

1. Field of the Invention

The present invention relates to gas lighter, and more particular to a safety device for a piezoelectric lighter, which is adapted to prevent the minor, especially under 5 years old, to ignite the lighter so as to guarantee the safety of children. The safety device of the piezoelectric lighter can also prevent the lighter from being accidentally or unintentionally ignited by the adults.

2. Description of Related Arts

It is well known that accidents cause by fire are some of the most horrible things that can happen to anyone. Over the years, there are hundreds of family who suffer from the damages caused by fire, some from the city fire and others got their home burned down around the green areas due to the forest fires. The community has always encouraged people to take any oncoming fire hazard, because we know that it's better to prevent the problem than to deal with it, and especially if we're dealing with an element of no mercy. Accidental fire had not only burned down homes and destroyed lives, but it also had killed many people over the years.

Most fires are caused accidentally by ignorance of human mistakes, especially among our young children. We tried to teach our young ones to not step into the accidental mistake of starting an accidental fire, but it is very difficult to enforce adult supervision over them twenty-four hours a day. In most accidental fire cases today, many were started by the ignorant usage of cigarette lighters, especially when someone in the family who is a smoker which having many cigarette lighters laying around the house waiting for the young one to pick it up and use it.

For protecting the safety and benefit of children, the U.S. Consumer Product Safety Commission imposed an important regulation that "Child below 5 years old cannot light the lighter". However, most of the piezoelectric lighters entirely alter the structural design of the lighter or incorporate complicate locking or switching mechanism with the lighter, that will largely increase the number of parts as well as the manufacturing cost and steps. Moreover, as we know, the children today are very intellectual in certain circumstances. If there is obvious a switch or button included on the lighter, they will soon to figure out how to work with that switch or button.

SUMMARY OF THE PRESENT INVENTION

A main object of the present invention is to provide a safety device for a piezoelectric lighter for preventing under age children from the usage of cigarette lighter without adult supervision.

Another object of the present invention is to provide a safety device for a piezoelectric lighter to normally lock up the piezoelectric unit to prevent the lighting operation of the piezoelectric lighter.

Another object of the present invention is to provide a safety device for a piezoelectric lighter, which can automatically return to a locking condition after each ignition operation, so as to prevent any lighting operation of the piezoelectric unit by locking up the downward movement of the pusher cap.

Another object of the present invention is to provide a safety device for a piezoelectric lighter, which does not require to alter the original structural design of the piezoelectric lighter, so as to minimize the manufacturing cost of incorporating said safety device with every conventional piezoelectric lighter having a pusher cap.

In order to accomplish the above objects, the present invention provides a safety device for a piezoelectric lighter, especially a kind of piezoelectric lighter as shown in FIG. 1, or other similar cigarette lighters and barbecue lighter, wherein the piezoelectric lighter comprises:

- a casing having a liquefied gas storage and a piezoelectric unit casing attaching to the liquefied gas storage and defining a pusher cavity therein, a top edge of an outer wall of the piezoelectric unit casing works functioning as a locking flange with a predetermined thickness;
- a gas ejection nozzle appearing from a ceiling of the casing and communicating with the liquefied gas storage for controlling the flow of gas;
- a piezoelectric unit fitted in the piezoelectric unit casing for generating piezoelectricity, wherein the piezoelectric unit comprises a movable operating part upwardly extended from the pusher cavity and an ignition tip connected thereto;
- a pusher cap slidably fitted in the pusher cavity of the casing in a vertically movable manner, the pusher cap being attached to a top end of the piezoelectric unit and comprising a cap body and a pusher head attaching on top of the cap body and exposing above the piezoelectric unit casing, wherein a locker groove is provided on an outer side of the cap body; and
- a safety device comprising a locking stopper fitted in the locker groove of the cap body of the pusher cap in an inwardly movable manner and a resilient unit mounted between the locking stopper and the pusher cap to normally urge and retain the locking stopper positioning between the pusher head and the locking flange of the piezoelectric unit casing so as to block any downwardly movement of the pusher cap and thus prevent the ignition operation of the piezoelectric unit. In other words, the piezoelectric lighter is locked from ignition normally. In order to ignite the piezoelectric lighter of the present invention, an adult user's thumb must intentionally push in the locking stopper until it is unblocked by the locking flange and push down the pusher cap at the same time.

DETAILED DESCRIPTION OF THE PREFERRED EMBODIMENTS

Figure 1:
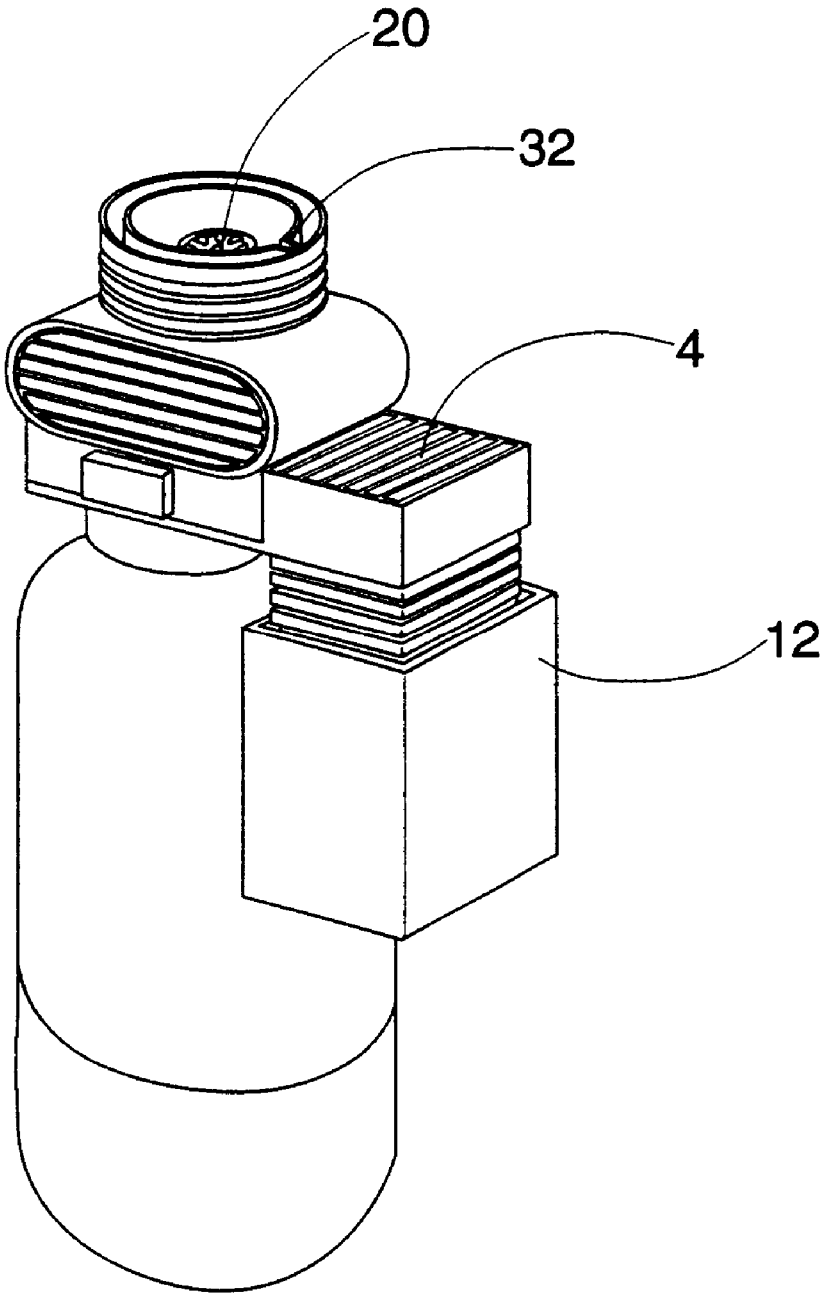
FIG 1 PRIOR ART
FIG. 1 is a perspective view of a traditional piezoelectric lighter of the type embodied in the present invention without equipping safety device.

Referring to FIG. 1, a traditional piezoelectric lighter without any safety mechanism is shown. In order to ignite such conventional piezoelectric lighter, a user may simply push down the pusher cap 4 that will downwardly drive and press a piezoelectric unit disposed inside a piezoelectric unit casing 12 to generate striking spark from a ignition tip 32 towards a gas ejection nozzle 20. Moreover, the downward movement of the piezoelectric unit will simultaneously operate to release gas, so that the ejecting gas will be ignited by the striking spark ejected from the gas ejection nozzle 20.

Figure 2:
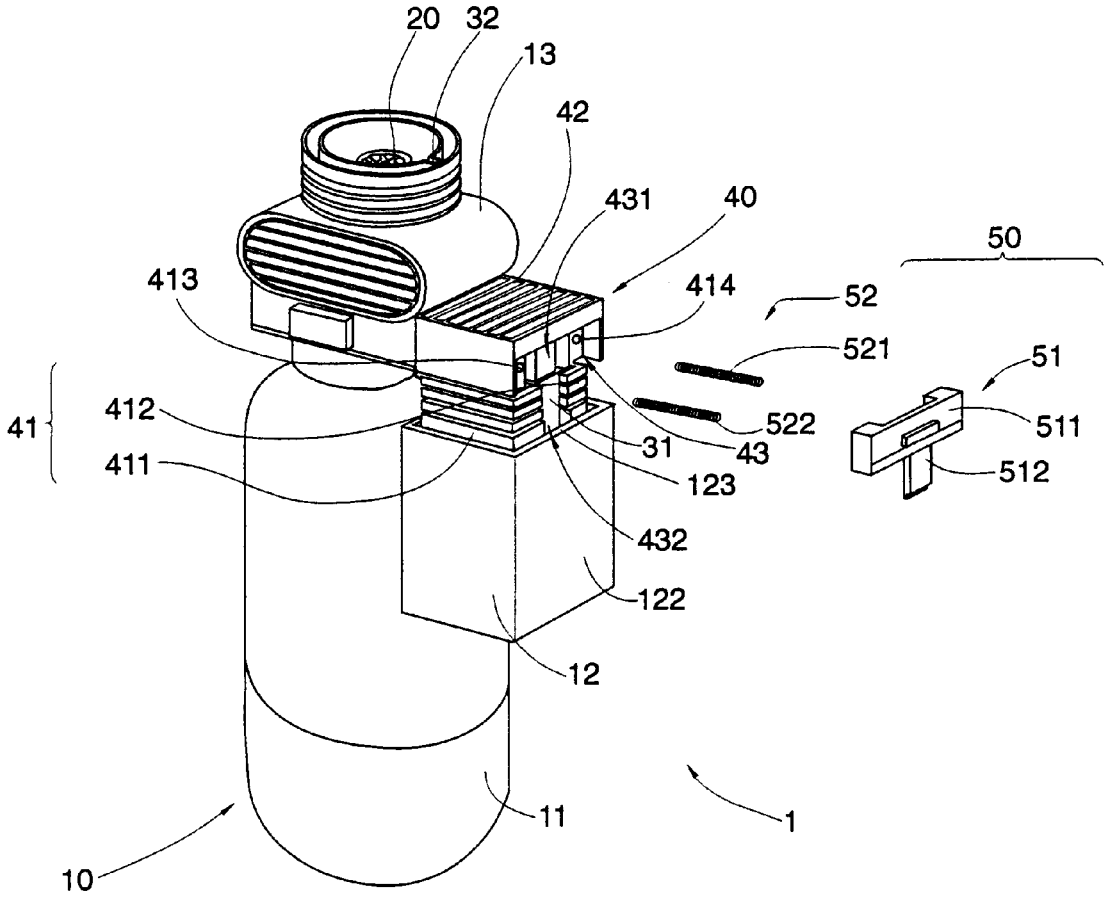
FIG. 2 is a partially exposed perspective view of a piezoelectric lighter equipped with a safety device according to a first preferred embodiment of the present invention.
Figure 3:
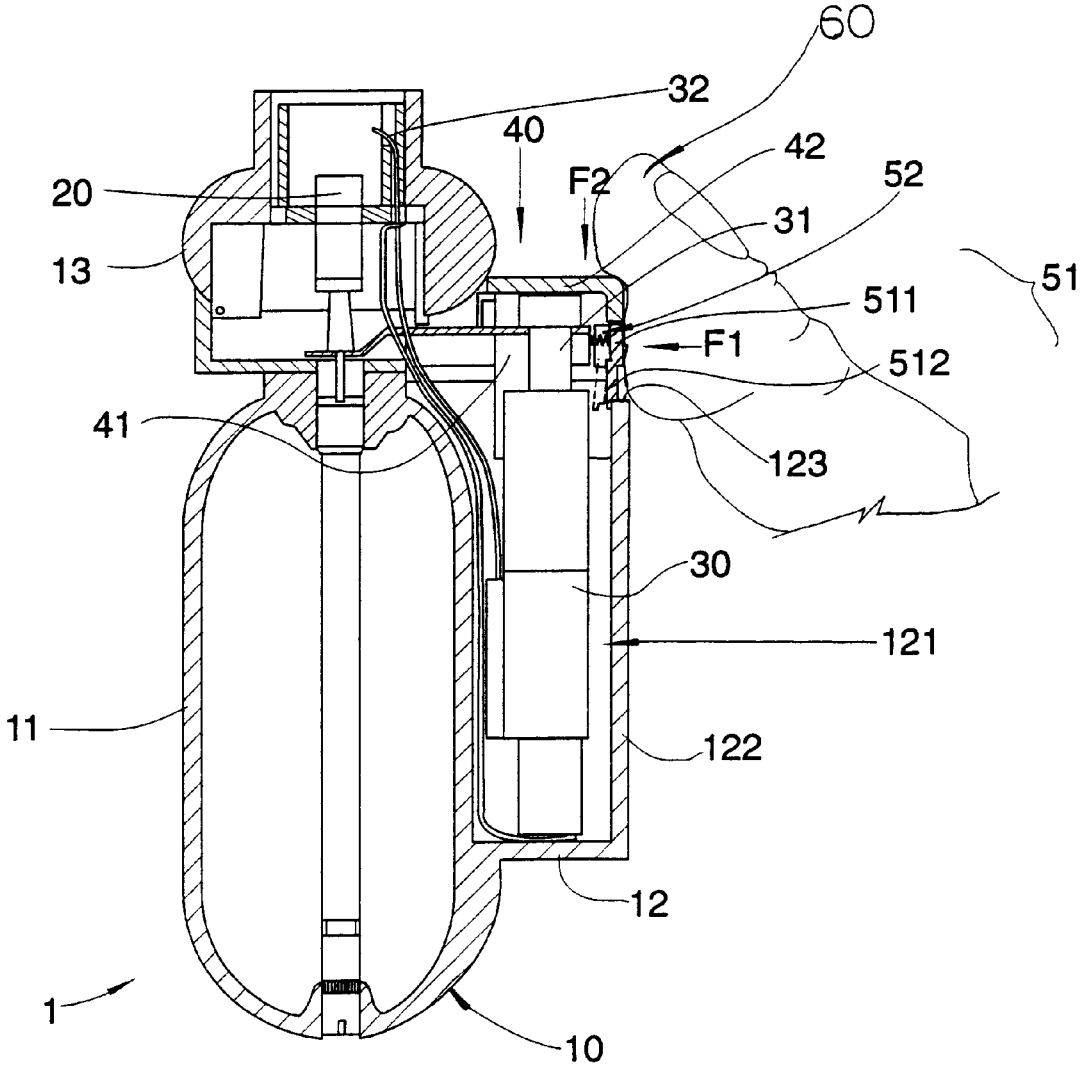
FIG. 3 is a sectional view of the piezoelectric lighter with safety device according to the above first preferred embodiment of the present invention.

Referring to FIGS. 2 and 3 of the drawings, a piezoelectric lighter equipped with a safety device according to a first preferred embodiment of the present invention is illustrated, wherein most of the components and parts remain the same as the traditional piezoelectric lighter as shown in FIG. 1 and only the structure of the pusher cap is changed to equip with the safety device of the present invention, so that the manufacturers can save a great amount of molding fee and manufacturing cost. In other words, the present invention does not require to alter the original structural design of the piezoelectric lighter, so that it can minimize the manufacturing cost and that said safety device can be incorporated with every conventional piezoelectric lighter having a pusher cap.

As shown in FIG. 3, the piezoelectric lighter 1, such as a standard piezoelectric lighter, comprises a casing 10, a gas ejection nozzle 20, a piezoelectric unit 30, and a pusher cap 40. The casing 10 comprises a liquefied gas storage 11 and a piezoelectric unit casing 12 which is attached to the liquefied gas storage 11 and defines a pusher cavity 121 therein.

As shown in FIG. 3, the gas ejection nozzle 20 appears from a ceiling of the piezoelectric unit casing 10 and communicating with the liquefied gas storage 11 for controlling the flow of gas. The piezoelectric lighter 1 further comprises a windshield 13 mounted on the ceiling of the casing 10 and encircling the gas ejection nozzle 20.

As shown in FIGS. 2 and 3, a top edge of an outer wall 122 of the piezoelectric unit casing 12 functions as a locking flange 123 with a predetermined thickness. The piezoelectric unit 30 is fitted in the piezoelectric unit casing 12 for generating piezoelectricity, wherein the piezoelectric unit 30 comprises a movable operating part 31 upwardly extended from the pusher cavity 121 and an ignition tip 32 connected thereto.

The modified pusher cap 40 is slidably fitted in the pusher cavity 121 of the piezoelectric unit casing 12 in a vertically movable manner. The pusher cap 40, which is attached to a top end of the piezoelectric unit 30, comprises a cap body 41 and a pusher head 42 attaching on top of the cap body 41 and exposing above the piezoelectric unit casing 12, wherein a locker groove 43 is provided on an outer side of the cap body 41.

As shown in FIG. 2, the locker groove 43, which is formed at an outer side of the cap body 41, has a wider upper portion 431 and a narrower lower portion 432. The cap body 41 comprises two side cap walls 411, 412 parallely and downwardly extended from the pusher head 42. The movable operating part 31 of the piezoelectric unit 30 is positioned between the two side cap walls 411, 412. On an upper portion of an outer surface of each side cap wall 411, 412, a spring hole 413, 414 is provided.

As shown in FIGS. 2 and 3, the present invention includes a safety device 50 which comprises a locking stopper 51 fitted in the locker groove 43 of the cap body 41 of the pusher cap 40 in an inwardly movable manner and a resilient unit 52 mounted between the locking stopper 51 and the pusher cap 40 to normally urge and retain the locking stopper 51 positioning between the pusher head 2 and the locking flange 123 of the piezoelectric unit casing 12 so as to block any downwardly movement of the pusher cap 42 and thus prevent the ignition operation of the piezoelectric unit 30.

According to the first preferred embodiment, the locking stopper 51 comprises a pushing button 511 having a shape and size adapted for fitting in the upper portion 431 of the locker groove 43 and a blocking tongue 512 downwardly extended from the pushing button 511. The blocking tongue 512 has a width narrower than a width of the pushing button 511 for fitting in the lower portion 432 of the locker groove 43. Normally, when the locking stopper 51 fits in the locker groove 43, the locking stopper 51 is positioned in a locking condition, that is blocked between the pusher head 42 and the locking flange 123.

As shown in FIG. 2, the resilient unit 52 comprises two compression springs 521, 522 each having one end inserted into the two spring holes 413, 414 and another end urging against an inner surface of the pushing button 511. By means of the resilient unit 52, such as the two compression springs 521, 522, the locking stopper 51 is normally urged and retained in the locking condition, i.e. positioning between the pusher head 42 and the locking flange 123 of the piezoelectric unit casing 12. Therefore, the pusher cap 40 is normally locked up by blocking its downwardly movement with the locking stopper 51. Even an adult is unable to press down the blocked pusher cap 40 as usual with his or her thumb to ignite the piezoelectric lighter 1 of the present invention.

In order to ignite the piezoelectric lighter 1 of the present invention, as shown in FIG. 3, an adult user's thumb 60 must intentionally push in the locking stopper 51 until it is unblocked with respect to the locking flange 123 and then press down the pusher cap 40 at the same time.

In other words, according to the present invention as shown in FIG. 3, in order to ignite the piezoelectric lighter 1, a sideward force F1 and a downward force F2 must be applied to the pushing button 511 and the pusher head 42 simultaneously but no switch is needed to operate. When the sideward force F1 inwardly pushes the pushing button 511, the blocking tongue 512 is pushed inwardly to an unlocking condition, where the blocking tongue 512 is disaligned with the locking flange 123, so that, at the same time, the downward force F2 can push down the pusher cap 40 to simultaneously press down the moveable operating part 31 of the piezoelectric unit 30 to ignite the piezoelectric lighter 1.

However, once the downward force F2 applied on the pusher cap 40 is released, the two springs 521, 522 of the resilient unit 52 will automatically push out the locking stopper 51 to return to its original locking position, i.e. positioning between the pusher head 42 and the locking flange 123 of the piezoelectric unit casing 12.

Figure 4:
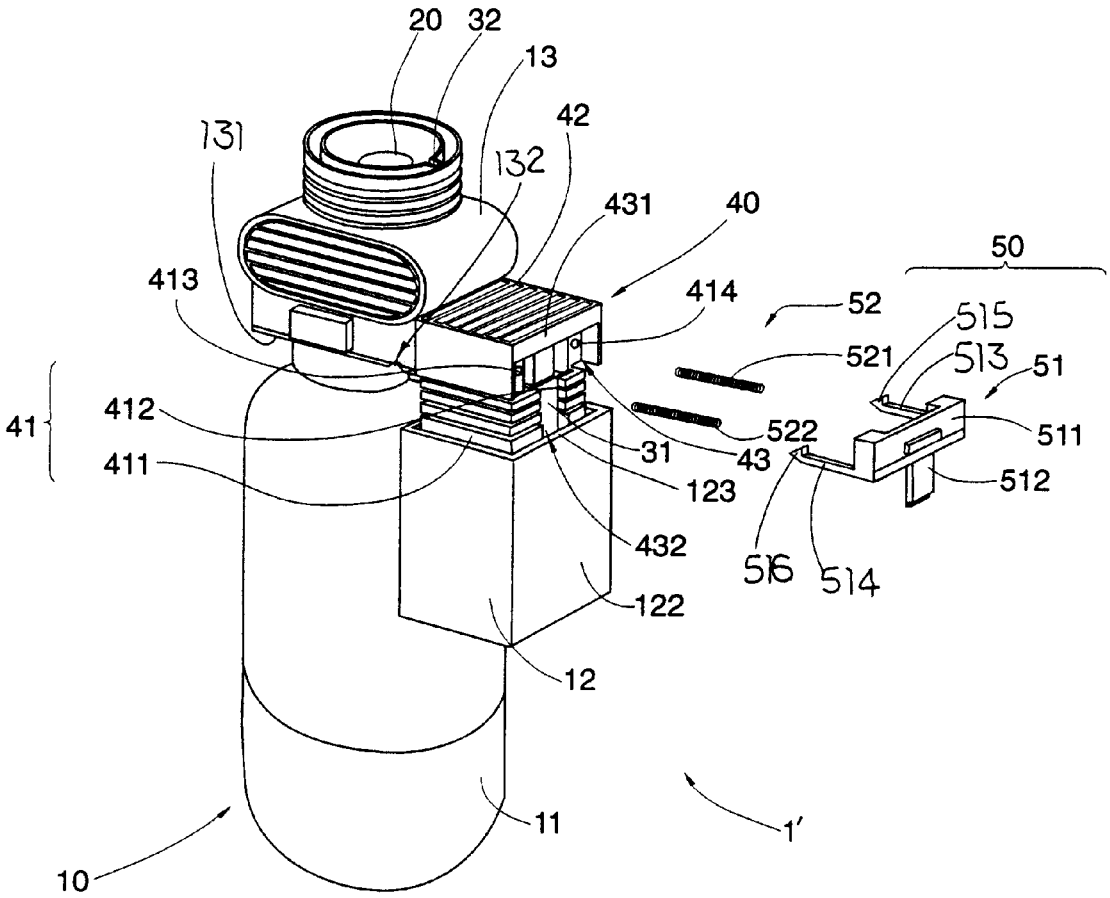
FIG. 4 is a partially exposed perspective view of a piezoelectric lighter equipped with a safety device according to a second preferred embodiment of the present invention.
Figure 5:
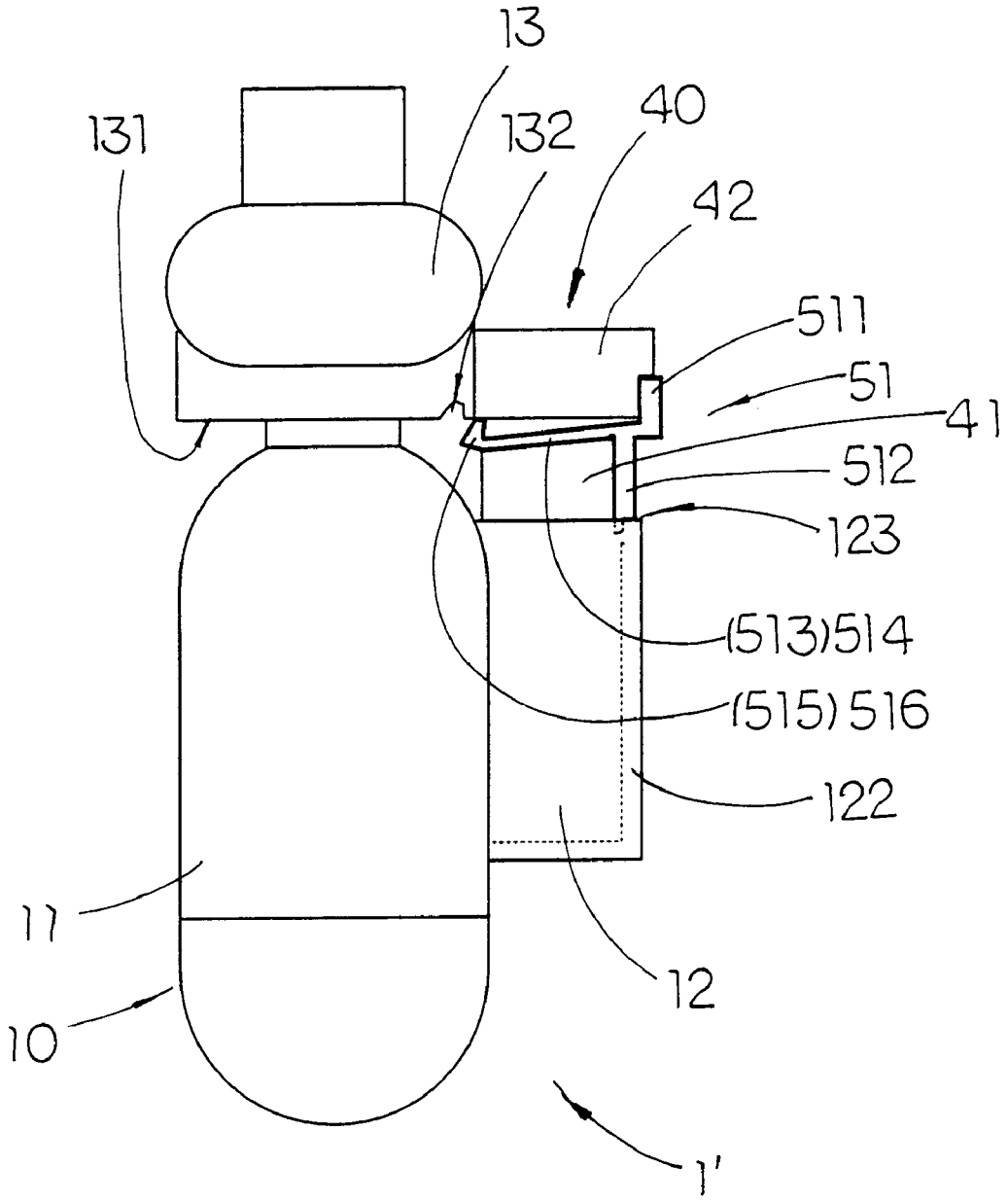
FIG. 5 is a schematic side view of the piezoelectric lighter with safety device according to the above second preferred embodiment of the present invention, wherein the safety device is in a locking condition.
Figure 6:
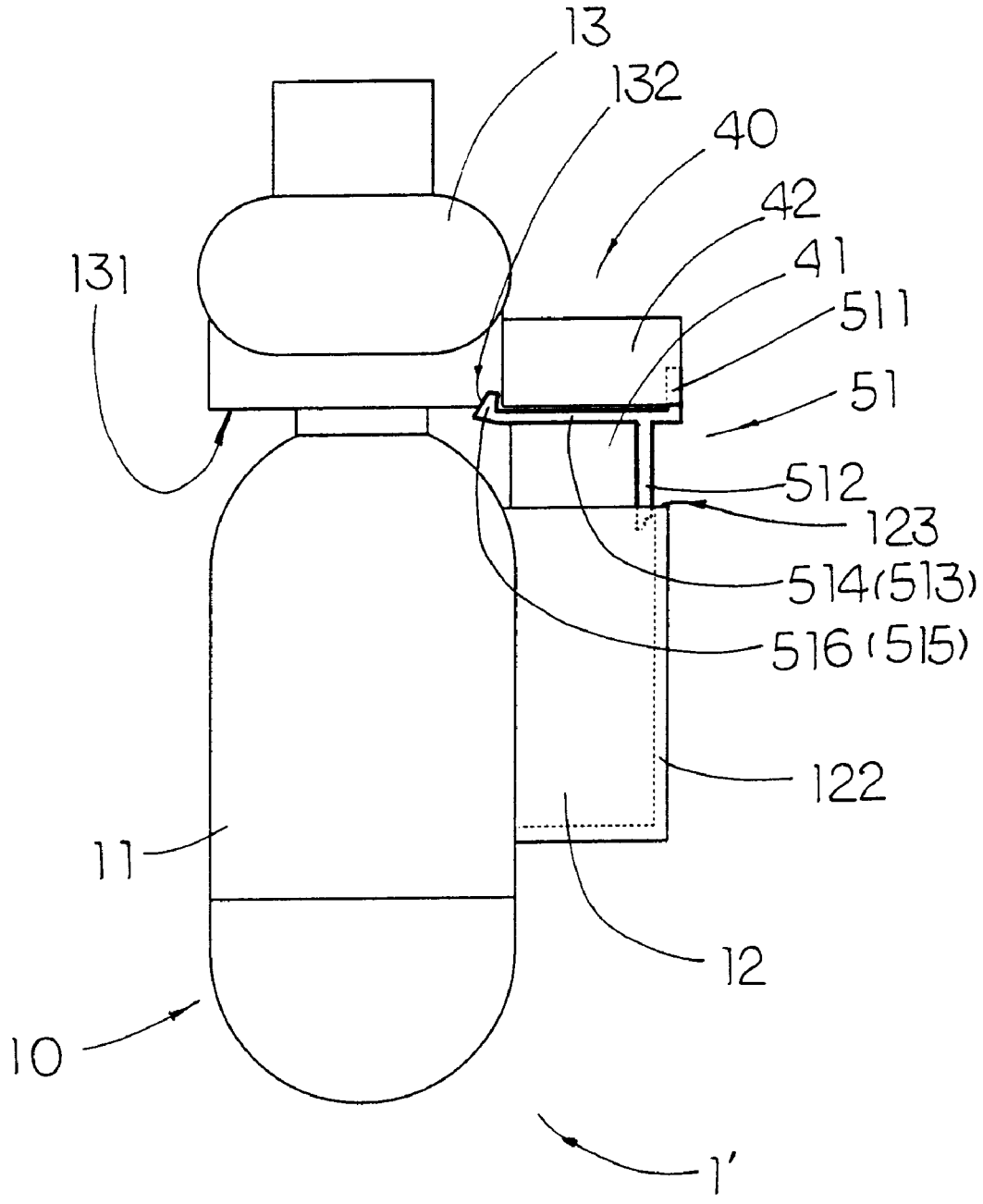
FIG. 6 is a schematic side view of the piezoelectric lighter with safety device according to the above second preferred embodiment of the present invention, wherein the safety device is in an unlocked condition.

Referring to FIGS. 4 to 6, a piezoelectric lighter 1' with a safety device according to a second preferred embodiment of the present invention, which is a modification of the above first preferred embodiment. Basically, the piezoelectric lighter 1' comprises identical components and structure as recited in the first preferred embodiment except that, as shown in FIG. 4, the locking stopper 51 of the safety device 50 further comprises two locking arms 513, 514 horizontally and elastically extended from two inner sides of the pushing button 511 thereof respectively, wherein a free end of each of the locking arms 513, 514 forms a triangular engagement latch 515, 516. Moreover, at two bottom sides 131 of the windshield 13 each forms an engagement socket 132 near the pusher head 42 adapted to receive the respective engagement latch 515, 516 therein.

As shown in FIGS. 5 and 6, the two locking arms 513, 514 are respectively extended underneath the two bottom sides of the pusher head 42 to enable the two engagement latches 515, 516 being reachable with respect to the two engagement sockets 132 respectively.

Normally, as shown in FIGS. 4 and 5, the two compression springs 521, 522 bias against the inner surface of the pushing button 511 to push the locking stopper 51 outwardly retained in the locking condition, as shown in FIG. 5, i.e. positioning between the pusher head 42 and the locking flange 123 of the piezoelectric unit casing 12. During the locking condition, the two engagement latches 515, 516 rest below the two bottom sides of the pusher head 42 without engaging with the two engagement sockets 132. Therefore, the pusher cap 40 is normally locked up by blocking its downwardly movement with the locking stopper 51. Even an adult is unable to press down the blocked pusher cap 40 as usual with his or her thumb to ignite the piezoelectric lighter 1' of the present invention.

To ignite the piezoelectric lighter 1 of the present invention, as shown in FIG. 6, a sideward force can first be applied to the pushing button 511 inwardly to push the locking stopper 51 inwardly until the two engagement latches 515, 516 of the two locking arms 513, 514 thereof are engaged with the two engagement sockets 132 respectively. During such unlocking condition, the pushing button 511 and the blocking tongue 512 are both retained in an inner position where the blocking tongue 512 is disaligned with the locking flange 123, so that the user may simply apply a downward force to push down the pusher cap 40 to press down the moveable operating part 31 of the piezoelectric unit 30 to ignite the piezoelectric lighter 1', as shown in FIGS. 4 and 6.

Furthermore, the downward force pressed on the pusher cap 40 also releases the engagement of the two engagement latches 515, 516 and the two engagement sockets 132, so that when the downward force applied on the pusher cap 40 is released, the two springs 521, 522 of the resilient unit 52 will automatically push out the locking stopper 51 to return to its original locking position as recited above.

In view of above, the safety device 50 of the present invention is perfectly childproof because a child is unable to operate the pushing in of the locking stopper 51 and the pressing down of the pusher cap 40 simultaneously. Moreover, it can automatically reset the locking stopper 51 to the locking position after each ignition of the piezoelectric lighter 1 or 1' by means of the resilient unit 52. In other words, the piezoelectric lighter 1 or 1' of the present invention is normally locked. Even after an ignition, no additional action has to take to re-lock the lighter. It will automatically re-lock again to provide better safety.

Figure 7:
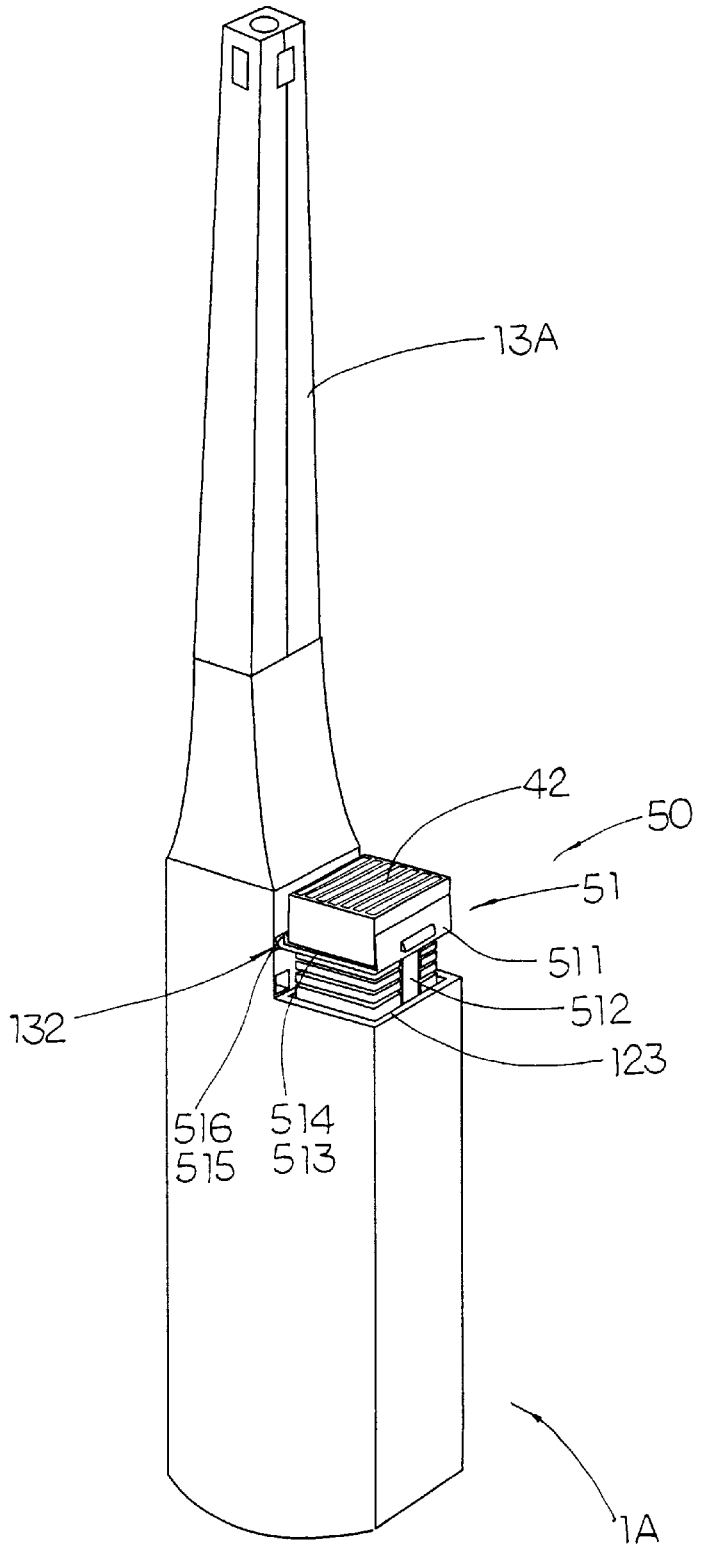
FIG. 7 is a perspective view of a barbecue lighter illustrating that the safety device of the present invention can also be equipped with the barbecue lighter instead of a cigarette lighter as shown in FIGS. 1 to 6.

The above first and second preferred embodiments as shown in FIGS. 1 to 6 embody the cigarette lighter. The safety device 50 for the piezoelectric lighter of the present invention can also be a barbecue lighter 1A, as shown in FIG. 7, where the windshield 13 of the cigarette type piezoelectric lighter 1 or 1', as shown in FIGS. 1 to 6, is replaced with an elongated nozzle tube 13A of the barbecue type piezoelectric lighter 1A, as shown in FIG. 7, while the other components and structure remain the same as the cigarette type piezoelectric lighter 1 or 1'. Accordingly, it is worth to mention that both the safety device 50 embodied in the above first and second embodiments can also be embodied in such a barbecue type piezoelectric lighter 1A.

Figure 8:
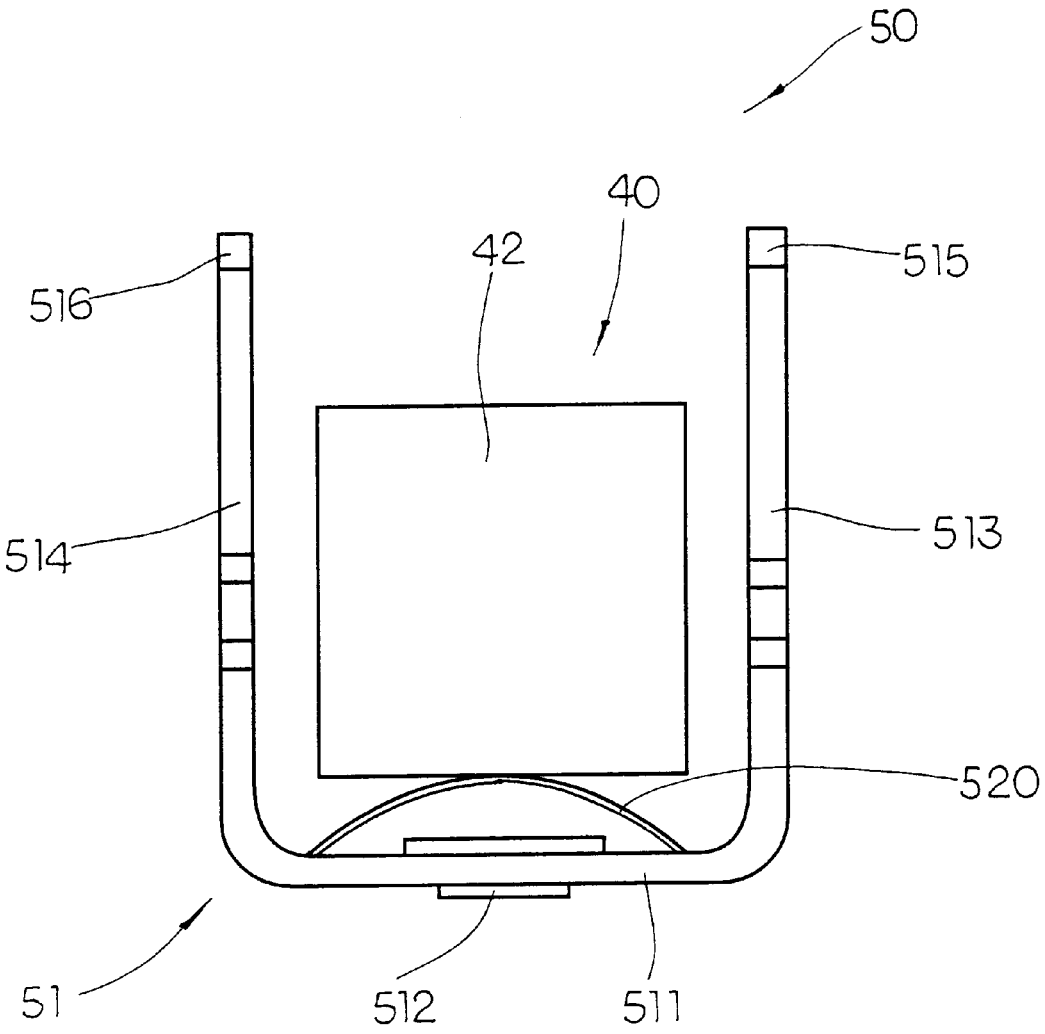
FIG. 8 is a top view illustrating a safety device having an alternative resilient unit for the present invention.

FIG. 8 illustrates an alternative mode of the resilient unit 52, wherein a curved spring strip 520 is capable of substituting the two compression springs 521, 522 as shown in FIGS. 1 and 4 for biasing against the locking stopper 51 outwardly by pressing two ends of the spring strip 520 against the pushing button 511 while the curved middle portion urging against the pusher head 42 of the pusher cap 40.

What is claimed is:

1. A piezoelectric lighter, comprising:

a casing which comprises a liquefied gas storage and a piezoelectric unit casing which is attached to said liquefied gas storage and defines a pusher cavity therein, wherein a top edge of an outer wall of said piezoelectric unit casing functions as a locking flange with a predetermined thickness;

a gas ejection nozzle which appears from a ceiling of said piezoelectric unit casing and communicating with said liquefied gas storage for controlling flowing of gas;

a piezoelectric unit fitted in said piezoelectric unit casing for generating piezoelectricity, wherein said piezoelectric unit comprises a movable operating part upwardly extended from said pusher cavity and an ignition tip connected thereto;

a pusher cap slidably fitted in said pusher cavity of said casing in a vertically movable manner, wherein said pusher cap is attached to a top end of said piezoelectric unit and comprises a cap body and a pusher head attaching on top of said cap body and exposing above said piezoelectric unit casing; and a safety device comprising a locking stopper disposed between said pusher head and said locking flange in an inwardly movable manner, and a resilient unit mounted between said locking stopper and said pusher cap to normally urge and retain said locking stopper positioning between said pusher head and said locking flange of said piezoelectric unit casing, so as to block any downwardly movement of said pusher cap and thus prevent ignition operation of said piezoelectric unit unless said locking stopper is pressed to move inwardly away from said locking flange.

2. A piezoelectric lighter, as recited in claim 1, wherein a locker groove is provided on an outer side of said cap body and said locking stopper is fitted in the locker groove of said cap body in said inwardly movable manner.

3. A piezoelectric lighter, as recited in claim 2, wherein said locker groove, which is formed at an outer side of said cap body, has a wider upper portion and a narrower lower portion, said cap body comprising two side cap walls parallely and downwardly extended from said pusher head, wherein said movable operating part of said piezoelectric unit is positioned between said two side cap walls, and on an upper portion of an outer surface of each of said two side cap walls, a spring hole is provided.

4. A piezoelectric lighter, as recited in claim 2, wherein said locking stopper comprises a pushing button having a shape and size adapted for fitting in said locker groove and a blocking tongue downwardly extended from said pushing button.

5. A piezoelectric lighter, as recited in claim 3, wherein said locking stopper comprises a pushing button having a shape and size adapted for fitting in said upper portion of said locker groove and a blocking tongue downwardly extended from said pushing button, said blocking tongue having a width narrower than a width of said pushing button for fitting in said lower portion of said locker groove, so that, normally, when said locking stopper fits in said locker groove, said locking stopper is positioned in a locking condition, that is blocked between said pusher head and said locking flange.

6. A piezoelectric lighter, as recited in claim 1, wherein said resilient unit comprises two compression springs each having one end urging against said cap body and another end pressing against said locking stopper.

7. A piezoelectric lighter, as recited in claim 3, wherein said resilient unit comprises two compression springs each having one end inserted into said two spring holes and another end urging against said locking stopper.

8. A piezoelectric lighter, as recited in claim 5, wherein said resilient unit comprises two compression springs each having one end inserted into said two spring holes and another end urging against an inner surface of said pushing button.

9. A piezoelectric lighter, as recited in claim 1, wherein said locking stopper further comprises two locking arms horizontally and elastically extended from two inner sides thereof respectively, wherein a free end of each of said locking arms forms an engagement latch, moreover, at two bottom sides of a windshield mounted on said ceiling of said casing, each forms an engagement socket near said pusher head adapted to engage with said two engagement latches respectively when said locking stopper is pressed inwardly until said locking stopper is disaligned with said locking flange.

10. A piezoelectric lighter, as recited in claim 2, wherein said locking stopper further comprises two locking arms horizontally and elastically extended from two inner sides thereof respectively, wherein a free end of each of said locking arms forms an engagement latch, moreover, at two bottom sides of a windshield mounted on said ceiling of said casing, each forms an engagement socket near said pusher head adapted to engage with said two engagement latches respectively when said locking stopper is pressed inwardly until said locking stopper is disaligned with said locking flange.

11. A piezoelectric lighter, as recited in claim 3, wherein said locking stopper further comprises two locking arms horizontally and elastically extended from two inner sides thereof respectively, wherein a free end of each of said locking arms forms an engagement latch, moreover, at two bottom sides of a windshield mounted on said ceiling of said casing, each forms an engagement socket near said pusher head adapted to engage with said two engagement latches respectively when said locking stopper is pressed inwardly until said locking stopper is disaligned with said locking flange.

12. A piezoelectric lighter, as recited in claim 4, wherein said locking stopper further comprises two locking arms horizontally and elastically extended from two inner sides of said pushing button thereof respectively, wherein a free end of each of said locking arms forms an engagement latch, moreover, at two bottom sides of a windshield mounted on said ceiling of said casing, each forms an engagement socket near said pusher head, wherein said two locking arms are respectively extended underneath said two bottom sides of said pusher head to enable said two engagement latches being reachable with respect to said two engagement sockets respectively, thereby during said locking condition, said two engagement latches rest below said two bottom sides of said pusher head without engaging with said two engagement sockets, however when a sideward force is applied to said pushing button inwardly to push said locking stopper inwardly until said two engagement latches of said two locking arms thereof are engaged with said two engagement sockets respectively, said pushing button and said blocking tongue are both retained in an inner position where said blocking tongue is disaligned with said locking flange, so that a downward force is able to push down said pusher cap to press down said moveable operating part of said piezoelectric unit to ignite said piezoelectric lighter.

13. A piezoelectric lighter, as recited in claim 5, wherein said locking stopper further comprises two locking arms horizontally and elastically extended from two inner sides of said pushing button thereof respectively, wherein a free end of each of said locking arms forms an engagement latch, moreover, at two bottom sides of a windshield mounted on said ceiling of said casing, each forms an engagement socket near said pusher head, wherein said two locking arms are respectively extended underneath said two bottom sides of said pusher head to enable said two engagement latches being reachable with respect to said two engagement sockets respectively, thereby during said locking condition, said two engagement latches rest below said two bottom sides of said pusher head without engaging with said two engagement sockets, however when a sideward force is applied to said pushing button inwardly to push said locking stopper inwardly until said two engagement latches of said two locking arms thereof are engaged with said two engagement sockets respectively, said pushing button and said blocking tongue are both retained in an inner position where said blocking tongue is disaligned with said locking flange, so that a downward force is able to push down said pusher cap to press down said moveable operating part of said piezoelectric unit to ignite said piezoelectric lighter.

14. A piezoelectric lighter, as recited in claim 6, wherein said locking stopper further comprises two locking arms horizontally and elastically extended from two inner sides thereof respectively, wherein a free end of each of said locking arms forms an engagement latch, moreover, at two bottom sides of a windshield mounted on said ceiling of said casing, each forms an engagement socket near said pusher head adapted to engage with said two engagement latches respectively when said locking stopper is pressed inwardly until said locking stopper is disaligned with said locking flange.

15. A piezoelectric lighter, as recited in claim 7, wherein said locking stopper further comprises two locking arms horizontally and elastically extended from two inner sides thereof respectively, wherein a free end of each of said locking arms forms an engagement latch, moreover, at two bottom sides of a windshield mounted on said ceiling of said casing, each forms an engagement socket near said pusher head adapted to engage with said two engagement latches respectively when said locking stopper is pressed inwardly until said locking stopper is disaligned with said locking flange.

16. A piezoelectric lighter, as recited in claim 8, wherein said locking stopper further comprises two locking arms horizontally and elastically extended from two inner sides of said pushing button thereof respectively, wherein a free end of each of said locking arms forms an engagement latch, moreover, at two bottom sides of a windshield mounted on said ceiling of said casing, each forms an engagement socket near said pusher head, wherein said two locking arms are respectively extended underneath said two bottom sides of said pusher head to enable said two engagement latches being reachable with respect to said two engagement sockets respectively, thereby during said locking condition, said two engagement latches rest below said two bottom sides of said pusher head without engaging with said two engagement sockets, however when a sideward force is applied to said pushing button inwardly to push said locking stopper inwardly until said two engagement latches of said two locking arms thereof are engaged with said two engagement sockets respectively, said pushing button and said blocking tongue are both retained in an inner position where said blocking tongue is disaligned with said locking flange, so that a downward force is able to push down said pusher cap to press down said moveable operating part of said piezoelectric unit to ignite said piezoelectric lighter.

* * * * *